US009573726B2

(12) United States Patent
Danesin et al.

(10) Patent No.: US 9,573,726 B2
(45) Date of Patent: Feb. 21, 2017

(54) PACKAGING SPLIT IN PARTS

(71) Applicant: NESTEC S.A., Vevey (CH)

(72) Inventors: Thomas Danesin, Neufchatel-en-Bray (FR); Sophie Marie Labrousse Molla, Amiens (FR); Pierre Henri Lebrand, Bonlier (FR)

(73) Assignee: Nestec S.A., Vevey (CH)

( * ) Notice: Subject to any disclaimer, the term of this patent is extended or adjusted under 35 U.S.C. 154(b) by 52 days.

(21) Appl. No.: 14/389,092

(22) PCT Filed: Jan. 30, 2013

(86) PCT No.: PCT/EP2013/051729
§ 371 (c)(1),
(2) Date: Sep. 29, 2014

(87) PCT Pub. No.: WO2013/143718
PCT Pub. Date: Oct. 3, 2013

(65) Prior Publication Data

US 2015/0166222 A1 Jun. 18, 2015

(30) Foreign Application Priority Data

Mar. 30, 2012 (EP) ..... 12162552

(51) Int. Cl.
*B65D 21/02* (2006.01)
*B65D 43/02* (2006.01)
(Continued)

(52) U.S. Cl.
CPC ..... *B65D 21/0217* (2013.01); *B65D 43/02* (2013.01); *B65D 55/02* (2013.01); *B65D 85/60* (2013.01)

(58) Field of Classification Search
CPC ..... B65D 2543/00296; B65D 2543/00259; B65D 43/0235; B65D 43/0206; B65D 43/0204
(Continued)

(56) References Cited

U.S. PATENT DOCUMENTS 4,951,866 A * 8/1990 Rusnak ..... 229/120.07
5,832,687 A * 11/1998 Willemsen ..... 52/592.6
(Continued)

FOREIGN PATENT DOCUMENTS

EP 1609734 12/2005

*Primary Examiner* — Viren Thakur
*Assistant Examiner* — Thanh H Nguyen
(74) *Attorney, Agent, or Firm* — K&L Gates LLP

(57) ABSTRACT

The present invention relates to a packaging comprising two containers (1, 2) each having an open end, and two lids. The two lids are a male lid (3) and a female lid (4) each having a topside and a underside and being adapted to close the open end of a container. The male lid (3) comprises a protrusion (7) and the female lid (4) comprises a cavity (8) adapted to receive the protrusion of the male lid. The protrusion (7) of the male lid has an edge (12) circulating at least a part of the protrusion at varying heights of the protrusion, and the cavity (8) comprises a ledge (13) mating the edge of the male lid, so that when the protrusion is received in the cavity the edge of the male lid abuts the ledge of the cavity. This results in that the two containers (1, 2) are combined into a single packing when the lids (3, 4) are arranged to close the opening of the containers and the protrusion (7) is received in the cavity (8). The packaging may be divided into two halves each comprising a container closed with a lid by turning movement of one of the lids relatively to the other lid resulting in the two lids being pushed away from each other by abutment between the ledge and the edge.

15 Claims, 3 Drawing Sheets

(51) Int. Cl.
*B65D 55/02* (2006.01)
*B65D 85/60* (2006.01)

(58) Field of Classification Search
USPC ..... 220/781, 380
See application file for complete search history.

(56) References Cited

U.S. PATENT DOCUMENTS

| | | | | |
|---|---|---|---|---|
| 7,337,917 | B2 * | 3/2008 | Kortleven | 220/793 |
| 2005/0189350 | A1 | 9/2005 | Hayes et al. | |
| 2006/0186014 | A1 | 8/2006 | Ramanujam et al. | |
| 2009/0000977 | A1 * | 1/2009 | Coonce | 206/503 |
| 2010/0003379 | A1 * | 1/2010 | Zoss et al. | 426/115 |
| 2012/0118848 | A1 * | 5/2012 | Hendrickson et al. | 215/40 |

* cited by examiner

PACKAGING SPLIT IN PARTS

CROSS REFERENCE TO RELATED APPLICATIONS

The present application is a National Stage of International Application No. PCT/EP2013/051729, filed on Jan. 30, 2013, which claims priority to European Patent Application No. 12162552.9, filed Mar. 30, 2012, the entire contents of which are being incorporated herein by reference.

FIELD OF THE INVENTION

The present invention relates to a packaging comprising two containers each having an open end, and two lids. The two lids are a male lid and a female lid each having a topside and a underside and being adapted to close the open end of a container. The male lid comprises a protrusion and the female lid comprises a cavity adapted to receive the protrusion of the male lid. The protrusion of the male lid has an edge circulating at least a part of the protrusion at varying heights of the protrusion, and the cavity comprises a ledge mating the edge of the male lid, so that when the protrusion is received in the cavity the edge of the male lid abuts the ledge of the cavity. This results in that the two containers are combined into a single packaging when the lids are arranged to close the opening of the containers and the protrusion is received in the cavity. The packaging may be devided into two halves each comprising a container closed with a lid as turning movement of one of the lids relatively to the other lid results in the two lids are pushed away from each other by abutment between the ledge and the edge.

BACKGROUND OF THE INVENTION

Today, a packaging for containing, transporting and storing until consumption e.g. food stuffs such as ice cream often comprises a container having a open end closed by a lid. The container may be re-closable by arranging the lid on the container after some of the content stored has been taken out from the container, or the container may be closed by a single time use lid, typically in the form of a sheet of plastic being welded to a rim encircling the open end of the container.

In many cases the volume of containers are selected so that the content stored either match a certain meal size in which case there is no need to reclose the container or the volume is selected to match a number of meal sizes, in which cases there is often a need to reclose the container for further storage.

When more than one container is desired by e.g. a consumer wishing more than one variety of a product, such containers with their content are either purchased separately, or in the form of multipacks or bundle regrouping individual containers. As an example, softdrinks cans are often sold in cartons containing e.g. six softdrinks cans. A multipack is usually a simple combination of packaging plus specific feature like tape, self adhesive label cardboard sleeve etc. That remains simple and only brings the grouping function. The convenience of such an execution is also limited. In particular, once the packaging/grouping assembly feature is removed, there is nothing to keep the several units from the multipack together.

US 2004/0245327 discloses an example of a separable dual carton for accommodating separate quantities of articles. The dual carton includes a plurality of panels hingeldly connected to one another. A center top panel includes a tear strip which overlies at least one starter orifice. The starter orifice is formed from apertures in opposing panels which are sized and positioned to register with one another when the dual carton is erected. By removing at least a portion of the tear strip, the starter orifice becomes accessible to facilitate the separation of the dual carton into separate individual cartons.

While such cartons solves the problem of keeping items such as cans in a fixed mutual relationship while being transported and stored, they still suffer from the problem that the carton maintains it original size although some or all cans are taken out from the carton, and at the same time the carton represent a disposal problem as the carton itself has no suitable use after being emptied from items.

Object of the Invention

Hence, an improved packaging is needed, and in particular a packaging bringing convenience, attractiveness and playfulness compared to known multipacks would be advantageous. It is a further object of the present invention to provide an alternative to the prior art.

SUMMARY OF THE INVENTION

Thus, the above described object and several other objects are intended to be obtained in a first aspect of the invention by providing a packaging comprising two containers each having an open end, and two lids, a male lid and a female lid each having a topside and a underside, each lid being adapted to close the open end of a container.

The male lid comprises a protrusion and the female lid comprises a cavity adapted to receive the protrusion of the male lid. The protrusion of the male lid has an edge circulating at least a part of the protrusion at varying heights of the protrusion. The cavity comprises a ledge mating the edge of the male lid, so that when the protrusion is received in the cavity the edge of the male lid abuts the ledge of the cavity, whereby, a turning movement of one of the lids relatively to the other lid results in the two lids are pushed away from each other by abutment between the ledge and the edge.

The present invention hereby provides a packaging in which two containers are combined into a packaging by the two lids which interact in a manner where a protrusion of male lid is received in a cavity of a female lid. The invention allows a good clipping and assembling. Hence, the consumer can perceive the packaging as one selling unit and can easily manipulate it, avoiding risk of dropping off. Thanks to the technical features of the male, respectively female lids, the assembling of the two halves can advantageously be made by a vertical "clipping" force, no matter the orientation. In many preferred embodiments, the clipping between the cavity and the protrusion is provided by a tight locking between the cavity and protrusion—such as a firm fit—and/or one or more ridges arranged on the protrusion as disclosed in further detailes below. The clipping between a container and a lid may preferably also be provided by a firm fit and/or one or more ridges arranged on the lid and/or container as disclosed in further details below.

Accordingly, clipping is used in a manner being ordinary to a skilled person and typically in a meaning to define the action of locking a lid on a container or locking the protrusion in the cavity. Thus, closing a container with a lid, may preferably be seen as clipping the lid on the container and similar for the action involving a protrusion and cavity.

The packaging provides typically a controlled disassembly as a turning of one of the lids relatively to the other provides the effect that the two lids are pushed away from each other. Often, lids are to be removed from the containers by a motion being different from the relative turning of the lids. According to the invention a turning motion separates the lids from each other—and thereby separates two halves of the packaging from each other—without separating the lids from the containers which is advantageous at least to the extent that unintentional opening of the container may be made less often occurring.

Furthermore, as the two halves of the packaging may be separated from each other without removal of the lids from the respective containers, the content of one container can be consumed without removing the lid of the other container. This is particularly advantageous for the stability and freshness of the products contained there-in, for example in the case of frozen confections, wherein products can suffer from heat shock and loose some of their organoleptic qualities when repetitively taken in and out of a freezer. With the present invention, the content of one of the container can be taken out of the freezer and consumed while the other remains closed in the freezer, therefore preserving its freshness.

Another effect of the container is a play-toy effect. The container has often four elements which can be assembled and separated many times and it has been found that the assembly and separation can be quite entertaining.

It is noted that although the present invention is disclosed as having mating protrusion and cavity provided in the lids, such mating cavity and protrustion may also be provided to the containers e.g. in the bottom, which may provide a packaging being a combination of containers into a stack of more than two container, such 4, 6, 8 or even 10 containers In the present context mate has preferably been used in an ordinary manner to define a mutual relationship between two elements, such as surface, egde and ledge, protrusion and cavity, which match each other in a manner where the fit together without space between.

Preferably, the protrusion of the male lid mates the cavity of the female lid. In preferred embodiments of the invention, each lid may comprises a skirt protruding downwardly from the top side of the lid and encircling the open end of a container when the lid is arranged to close the container.

Alternatively or in combination thereto, each of the containers may comprise an outwardly folded part at the open end, and each skirt may comprise a ridge engaging with the outwardly folded part in a firm fit when the lid is arranged to close the container.

Preferably, the protrusion is cylindral. In combination thereto, the upper surface of protrusion may preferably be formed as a centrally arranged plane square preferably being perpendicular to the longitudinal extension of the protrusion and preferably having a diagonal being smaller than the diameter of the male protrustion. Furthermore, a straight plane may preferably extend from each side of the square shaped upper surface to the outer surface of the protrusion in sloped manner in the form of a segment of a circle.

In preferred embodiments of packagings according to the present invention, the male protrusion may comprise one or more ridges arranged to engage with the cavity preferably to provide a firm fit between the protrusion and the cavity when the protrusion is received in the cavity.

Preferably, a packaging according to the present invention comprises the containers shaped as frustum of a pyramid.

In many preferred embodiments of the present invention, the containers are identical. Alternatively or in combination thereto each container may be box shaped, such as shaped as a frustrum of a pyramid, or cylindrical, or cone shaped, such as frustum of a cone. Preferably, packagings according to the present invention when assembled has the form of a cube. This arrangement is advantageous from a space optimization standpoint.

Preferably, the containers and lids may be made from the same material, such as a thermoplastic material such as polypropylene, PET, polystyrene, ABS or the like. Materials such as metals and combinations of metal and plastic are also preferred in accordance with the present invention.

Preferably, the containers and lids are injection moulded.

In combination with the above, packagings according to the present invention may further comprise securing means maintaining the containers and lids in an assembled state, so as to prevent unintentional separation of lids from the containers and unintentional separation of the lids from each other. Preferably, the securing means may comprise a tear off strip encircling the packaging.

The present invention relates in a second aspect to a food article. Such food articles comprise a packaging according to first aspect of the invention in an assembled state and have one or more food products contained in the containers.

Preferably, a first food product is contained in one container and a second food product is contained in another container of the packaging- the two food products may be the same product or two different food products. The food product(s) may be a confectionary product, such as frozen confections e.g. ice cream, cookies, chocolates, cereals, dehydrated powder.

Alternatively, one of the containers may contain a food product and the other container may contain accessories to prepare (such as seasoning mix, roasting bag etc) or for consuming the food product (such as set of knife, fork and spoon, napkins etc).

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
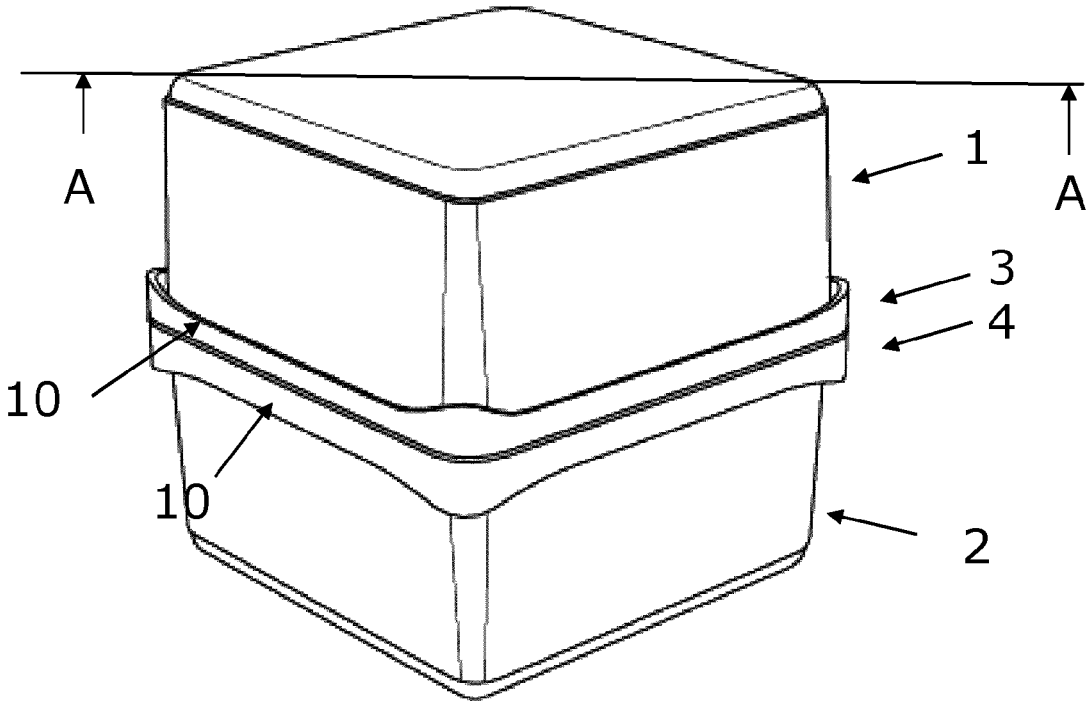
FIG. 1 shows schematically in a 3-dimensional view a packaging in an assembled state, wherein a protrusion of a male lid is received in a cavity of a female lid, according to an embodiment of the invention.

Reference is made to FIG. 1 which shows schematically and in a 3-dimensional view a packaging according the present invention. The packaging comprises two containers 1, 2 each having an open end (not shown in the figures as the lids are covering the openings). The container of FIG. 1 is shown in an assembled state which will be elucidated further below. The two lids are formed each as a male lid 3 and a female lid 4 (see e.g. FIG. 3) which refers to the fact that the male lid 3 has a part fitting into female lid 4. As ordinary, each lid 3, 4 has a topside and a underside where the underside is the side facing towards the innerside of the container to which is applied and the topside is the reverse side. Each of the lids is adapted to close the open end of a container 1, 2. Typically, the lids are adapted to close the container in a firm fit in manner which mechanically closes the container so that liquids or powdery substances stored in the container are not leaking out. The actual mechanical closure is selected in accordance with a specific need and may be complemented by a sheet material welded to the open end of the container 1, 2 thereby constituting sealing below the lids 3,4.

As shown in the figures, the lids 3, 4 are generally square shaped planform with rounded corners. However, the lids 3, 4 may be given other shaped such as circular or polygonal.

Figure 3:
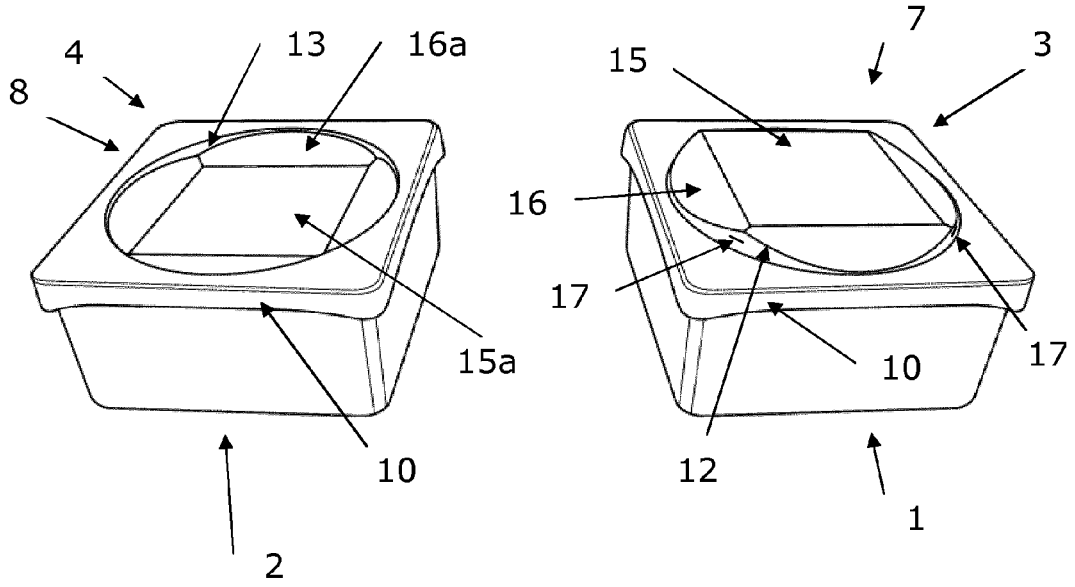
FIG. 3 shows schematically in a 3-dimensional view the male and the female lids of the packaging shown in FIG. 1; the lids are shown in their position on the containers where they close the containers.

With reference to FIG. 3, the male lid 3 is shaped so as to comprise a protrusion 7 and the female lid to comprise a cavity 8. The cavity is adapted to receive the protrusion 7 of the male lid 3 typically and preferably to such an extend that area outside the protrusion 7 and cavity 8 of the topsides of the lids 3,4 abut each other or a small gap, typically in the order of 0.5 to 2 mm, is present between the lids 3,4.

Figure 2:
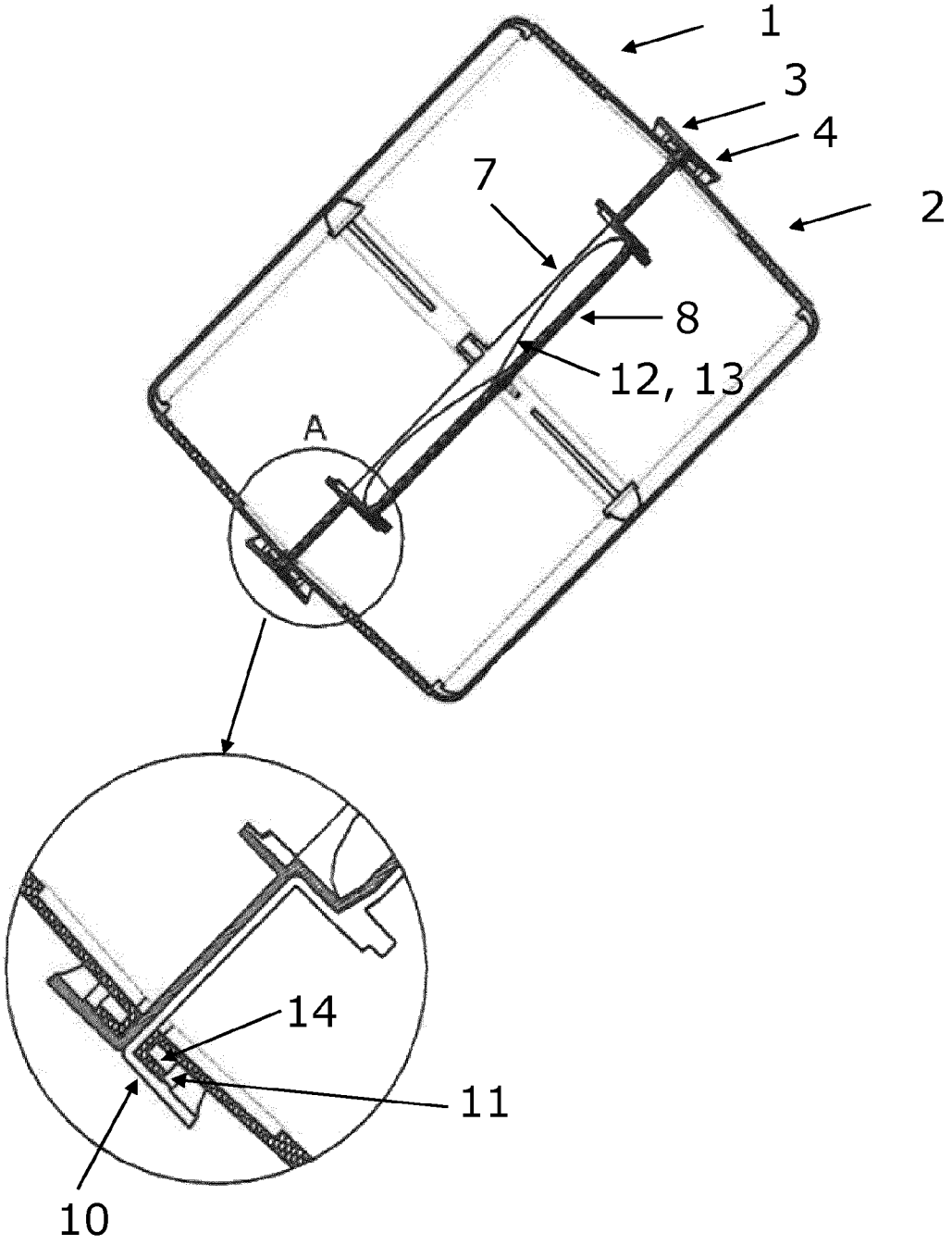
FIG. 2 shows a cross sectional view of the packaging of FIG. 1 along line A-A of FIG. 1.

When the protrusion 7 is received in the cavity 8 and at the same time the lids 3, 4 are arranged to close the open ends of the containers 1, 2 the packaging is said to be in an assembled state. A cross section of the packaging along line A-A of FIG. 1 is disclosed in FIG. 2. As presented in FIG. 2, the protrusion 7 is fully received in the cavity 8 which results in that the areas of the lids outside the protrusion 7 and cavity 8 abut each other.

With reference to e.g. FIG. 3, the protrusion 7 of the male lid 3 has an edge 12 circulating at least a part of the protrusion 7 at varying heights of the protrusion 7. It is noted that the edge may be provided to circulate only a part of the protrusion 7. The edge 12 co-operates with a ledge provided in the female lid 4 for separating the two lids 3,4 and for that purpose, the cavity 8 has a ledge 13 mating the edge 12 of the male lid, so that when the protrusion 7 is received in the cavity 8, the edge 12 of the male lid 3 abuts the ledge 13 of the cavity 8. The ledge in the embodiment of FIG. 3, is defined by the corner in the bottom of the cavity 8. However, the actual position and shape of the edge 12 and ledge 13 may be selected differently as long as they mate each other.

As the edge 12 and ledge 13 mate and circulate at various heights—see FIG. 3 wherein the edge 12 and the ledge 13 describes a wavy evolution—a turning movement of one of the lids 3,4 relatively to the other lid results in the two lids being pushed away from each other by abutment between the ledge 13 and the edge 12. The turning may be provided by hand and by turning one or both lids.

As depicted in FIG. 3 the protrusion 7 of the male lid 3 mates the cavity 8 of the female lid 4. This means that the protrusion 7 can be fully received in the cavity 8 and that the cavity 8 may be characterised as an imprint of the protrusion 8, although the dimensions of the protrusion 8 in many cases are designed to be slightly smaller e.g. in the order of 0.01% to allow for easy receipt of the protrusion 7 in the cavity 8 and easy separation of the two lids 3,4 from each other.

Each lid 3, 4 has a skirt 10 protruding downwardly from the top side of the lid 3, 4, and encircling the open end of a container 1, 2, when the lid is arranged to close the container 1,2. The skirt may provide two functions namely to assist correct placement of the lids 3, 4 onto the open end of the containers 1, 2 as the skirts 10 act as a guide and they function as a grip for fingers or tools to ease removal of the lids 3, 4 from the open end of the containers 3, 4. Furthermore, each of the containers has an outwardly folded part 14 at the open end which co-operates with a skirt 10 of lid to provide a firm fit. The firm fit provided by each skirt has a ridge 11 circulating inside the skirt and engaging with the outwardly folded part 14 of the container in a firm fit when the lid is arranged to close the container. The ridge 11 is preferably arranged at the skirt 10 below the outwardly folded part 14. Thereby, lids 3, 4 in combination with the containers 1, 2 are typically designed to provide a snap-fit of the lids 3, 4 onto the containers 1, 2.

The protrusion 7 is cylindrally shaped as shown most evident in FIG. 3. It is noted that the height of the protrusion 7 is relatively small compared to the diameter of the cylinder (the ratio between height and diameter is typically in the order of 7-8 mm/90-100 mm) where the height is measured between the highest point of the protrusion and the area of the topside of the lid outside the protrusion 7.

The upper surface of protrusion is formed as a centrally arranged plane square 15 being perpendicular to the longitudinal extension of the protrusion and having a diagonal being smaller than the diameter of the male protrustion. Thereby, a straight plane 16 extends from each side of the square shaped upper surface 15 to the outer surface of the protrusion 7 in sloped manner in the form of a segment of a circle 16. By this design, the edge 12 is formed as four circle arc segments coinciding at the corners of the lids 3, 4. The ledge 13 mates this form and has a centrally arranged plane square 15*a* and four circle segments 16*a*.

To enhance the grip between the lids 3, 4, the male protrusion has ridges 17 arranged in four regions vertical regions of the protrusion opposite to the corners of the plane square 15, which ridges engage with the wall of the cavity to provide a firm fit between the protrusion 7 and the cavity 8 when the protrusion is received in the cavity. However, the ridges may be arranged in the cavity 8 in similar positions instead—or in combination thereto.

The shape of the packaging may differ according to certain preferences and needs for storage. Typically the shape of the packaging is dictated by the shape of the containers 1, 2 and the lids 3, 4 followed by the design of the containers 1, 2 as they are adapted to close the containers 1, 2. Typically and preferred embodiments of the packaging include containers 1, 2 shaped as frustum of a pyramid as disclosed in FIG. 1. Furthermore, the containers 1, 2 are identical as disclosed in FIG. 1.

Thus, the containers 1, 2 are preferably each box shaped, such as shaped as a frustrum of a pyramid, or cylindrical, or cone shaped, such as frustum of a cone. The box shaped containers including the containers 1, 2 shown in FIG. 1 being shaped as frustrum of a pyramid provides a packaging in form of a cube when assembled.

The containers 1, 2 and lids 3, 4 are made from the same material being a thermoplastic material such as polypropylene, PET, polystyrene, ABS or the like and the containers 1, 2 and the lids 3, 4 are produced by injection moulding.

Although the grip between protrusion and cavity provides a certain safety against unintentional separation, it may be desired to provide a further safety against such unintentional separation. To this, the packaging has means (not shown in the figures) maintaining the containers and lids in an assembled state, so as to prevent unintentional separation of lids from the containers and unintentional separation of the lids from each other. Such means includes a plastic or paper wrapping, a strip or the like and optionally provided with printing showing the content of the containers 1, 2, instruction for accessing the content of the containers etc. In a particular embodiment, the securing means comprising a tear off strip encircling the packaging.

Although not limited to this purpose, the packaging forms part of or constitute a food article, where the packaging is in assembled state and has one or more food products contained the container. Typically and preferably, a first food product is contained in one container 1 and a second food product is contained in another container 2 of the packaging. The food product(s) is(are) e.g. a confectionary product, such as frozen confections e.g. ice cream, cookies, chocolates, cereals, dehydrated powder.

While the above disclosure has presented an embodiments with protrusion 7 and cavity 8 provided in the lids, it is envisaged and considered within the scope of the present invention that the a cavity 8 and a protrusion 7 may be provided in the bottom of the containers 1, 2. Thereby, a lid having a protrusion 7 may engage with a bottom of a container having a cavity 8 so that a stack of containers with lids comprising more than two containers may be provided. Furthermore, a packaging may be provided by arranging the protrusion 7 provided in a bottom of one container into a cavity 8 provided in the bottom of another container.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A packaging comprising:

two containers each having an open end; and two lids comprising a male lid and a female lid, each lid having a topside and an underside, and adapted to close the open end of a corresponding container of the two containers, the male lid comprising a protrusion, the female lid comprising a cavity adapted to receive the protrusion of the male lid, the protrusion of the male lid comprising (1) a cylindrical ridge having varying heights and defining a circular periphery of the protrusion, (2) a centrally arranged planar square perpendicular to a longitudinal extension of the protrusion and forming an upper surface of the protrusion, and (3) a flat surface extending from each side of the upper surface to the cylindrical ridge in a sloped manner in the form of a segment of a circle, the cavity comprising a ledge mating an edge of the male lid, so that when the protrusion is received in the cavity, the edge of the male lid abuts the ledge of the cavity, and a turning movement of one of the lids relatively to the other lid results in the two lids being pushed away from each other by abutment between the ledge and the edge, and the circular periphery of the protrusion in its entirety, fitting into the cavity without space therebetween.

2. The packaging according to claim 1, wherein the protrusion of the male lid is mated with the cavity of the female lid.

3. The packaging according to claim 1, wherein each lid comprises a skirt protruding downwardly from the upper side of the lid and encircling the open end of the corresponding container, when the lid is arranged to close the corresponding container.

4. The packaging according to claim 3, wherein:

each of the two containers comprises an outwardly folded part at the open end; and each skirt comprises a ridge arranged to engage with the outwardly folded part in a firm fit when the lid is arranged to close the corresponding container.

5. The packaging according to claim 1, wherein the upper surface of the protrusion has a diagonal smaller than a diameter of the protrusion.

6. The packaging according to claim 1, wherein the cylindrical ridge is arranged to engage with the cavity to provide a firm fit between the protrusion and the cavity when the protrusion is received in the cavity.

7. The packaging according to claim 1, wherein the two containers are shaped as frustum of a pyramid.

8. The packaging according to claim 1, wherein the two containers are identical and each have a shape selected from the group consisting of box shaped, cylindrical, and cone shaped.

9. The packaging according to claim 1, wherein the two containers and the two lids are made from the same thermoplastic material.

10. The packaging according to claim 1, wherein the two containers and the two lids are injection molded.

11. The packaging according to claim 1, further comprising a securing member maintaining the two containers and the two lids in an assembled state to prevent unintentional separation of the two lids from the two containers and unintentional separation of the two lids from each other.

12. The packaging according to claim 11, wherein the securing member comprises a tear off strip encircling the packaging.

13. A food article comprising:

a packaging comprising:

two containers each having an open end; and two lids comprising a male lid and a female lid, each lid having a topside and an underside, and adapted to close the open end of one of the two container, the male lid comprising a protrusion, the female lid comprising a cavity adapted to receive the protrusion of the male lid, the protrusion of the male lid comprising (1) a cylindrical ridge having varying heights and defining a circular periphery of the protrusion, (2) a centrally arranged planar square perpendicular to a longitudinal extension of the protrusion and forming an upper surface of the protrusion, and (3) a flat surface extending from each side of the upper surface to the cylindrical ridge in a sloped manner in the form of a segment of a circle, the cavity comprising a ledge mating an edge of the male lid, so that when the protrusion is received in the cavity, the edge of the male lid abuts the ledge of the cavity, and a turning movement of one of the lids relatively to the other lid results in the two lids being pushed away from each other by abutment between the ledge and the edge in an assembled state and at least one of the two containers having one or more food products contained therein, and the circular periphery of the protrusion in its entirety, fitting into the cavity without space therebetween.

14. The food article according to claim 13, wherein a first food product is contained in one container of the two containers, and a second food product is contained in the other container of the two containers.

15. The food article according to claim 13, further comprising a food product, wherein the food product is a confectionary product.

* * * * *